US005762719A

United States Patent [19]

D'Muhala et al.

[11] Patent Number: 5,762,719

[45] Date of Patent: Jun. 9, 1998

[54] TERPENE BASED CLEANING COMPOSITION

[75] Inventors: Thomas F. D'Muhala, Raleigh; Thomas C. Zietlow, Cary, both of N.C.

[73] Assignee: Corpex Technologies, Inc., Morrisville, N.C.

[21] Appl. No.: 848,882

[22] Filed: May 1, 1997

Related U.S. Application Data

[60] Provisional application No. 60/002,137 Aug. 10, 1995.

Related U.S. Application Data

[62] Division of Ser. No. 644,325, May 10, 1996, Pat. No. 5,663,135.

[51] Int. Cl.[6] ..... B08B 3/08

[52] U.S. Cl. ..... 134/42; 510/463; 510/500

[58] Field of Search ..... 134/42; 510/463, 510/500

[56] References Cited

U.S. PATENT DOCUMENTS

| | | | |
|---|---|---|---|
| 4,511,488 | 4/1985 | Matta | 252/162 |
| 4,620,937 | 11/1986 | Dellutri | 252/143 |
| 5,011,621 | 4/1991 | Sulivan | 252/162 |
| 5,112,516 | 5/1992 | Koetzle | 252/162 |
| 5,132,039 | 7/1992 | Sugita et al. | 252/162 |
| 5,213,624 | 5/1993 | Williams | 134/40 |
| 5,288,335 | 2/1994 | Stevens | 134/38 |
| 5,298,184 | 3/1994 | Jarema | 252/171 |
| 5,356,482 | 10/1994 | Mehta et al. | 134/22.1 |
| 5,427,710 | 6/1995 | Stevens | 252/166 |
| 5,464,555 | 11/1995 | Bayless | 252/153 |
| 5,468,415 | 11/1995 | Jarema | 252/171 |
| 5,498,805 | 3/1996 | Koetzle | 568/827 |

*Primary Examiner*—Paul Lieberman
*Assistant Examiner*—John R. Hardee
*Attorney, Agent, or Firm*—Myers Bigel Sibley & Sajovec

[57] ABSTRACT

A composition and method for decontaminating a surface is disclosed. Specifically, the composition comprises 20 to 50 percent by weight of a terpene-based component, 20 to about 40 percent by weight of an alkyl pyrrolidone, and 5 to about 40 percent by weight of a surfactant.

8 Claims, No Drawings

TERPENE BASED CLEANING COMPOSITION

This application is a divisional of application Ser. No. 08/644,325, filed 10 May 1996, now U.S. Pat. No. 5,663,135, which is a continuation of provisional application Ser. No. 60/002,137 filed 10 Aug. 1995.

FIELD OF THE INVENTION

The present invention relates to a composition and method for decontaminating a surface. More particularly, the invention relates to a composition and method of decontaminating a coated or uncoated metal surface containing organic contaminants.

BACKGROUND OF THE INVENTION

Organic materials designed for commercial and industrial use are often transported in equipment having a metal surface. Typical organics include oils, greases, latexes, waxes, paraffins, tars, asphaltenes, and the like, and typical metals which are employed include carbon steel, stainless steel, copper, aluminum, brass, and alloys. Specifically, the organic materials often contaminate the metal surfaces they are contained or transported in such as organic materials transported in rail cars; processing equipment employed in petrochemical plants and refineries; ship tanks; and the like. Typically these objects are cleaned in hot caustic solution to dissolve the organic contaminant. Using such a solution, however, suffers from numerous drawbacks.

Caustic is relatively slow to clean a vessel because chemical hydrolysis has to occur. Moreover, the caustic is dangerous to handle for workers since skin contact often results in chemical burns. The caustic can also react with ammonium-based contaminants to release free ammonia which is a hazard and irritant to workers. Caustic solution is not very reusable and must be totally disposed of as a hazardous waste due to contaminants and high pH (>12).

U.S. Pat. No. 5,356,482 to Mehta et al. proposes a process for decontaminating process equipment and vessels. In particular, Mehta et al. proposes utilizing a cleaning agent such as a terpene-based extractant which is vaporized by the use of steam to remove organic contaminants, particularly potentially hazardous contaminants such as benzene. The use of steam, however, is disadvantageous in that it requires additional cost in terms of energy needed to vaporize the water.

It would be desirable to provide a composition and method of decontaminating a surface which utilizes substantially non-hazardous chemicals which are biodegradable, and does not require steam in the contaminant removal process. Moreover, it would be particularly desirable to provide a composition and method for decontaminating a surface such that subsequent to decontamination, the composition may be readily re-used.

SUMMARY OF THE INVENTION

In view of the above, it is an object of the present invention to provide a composition and method for decontaminating surfaces wherein the composition employs substantially non-hazardous materials and is biodegradable.

It is a further object of the present invention to provide a composition and method for decontaminating surfaces which may be employed at lower temperatures and accordingly does not require the use of steam.

It is yet another object of the present invention to provide a composition and method for decontaminating surfaces such that the composition may be separated from the contaminant and thus may be readily re-usable.

To these ends and others, the present invention provides a composition suitable for removing organic contaminants. Specifically, the composition comprises about 20 to about 50 percent by weight of a terpene-based component, about 20 to about 40 percent by weight of an alkyl pyrrolidone, and about 5 to about 40 percent by weight of a surfactant.

The present invention also provides a method of decontaminating a surface. Specifically, the method comprises providing a metal surface having the organic contaminant, contacting the metal surface with a composition which comprises 20 to 50 percent by weight of a terpene-based component, 20 to 40 percent by weight of an alkyl pyrrolidone, and 5 to 40 percent by weight of a surfactant. In a preferred embodiment, the method further comprises separating the composition from the contaminant such that the composition may be re-usable.

DETAILED DESCRIPTION OF THE PREFERRED EMBODIMENTS

The present invention will now be described more fully hereinafter. This invention may, however, be embodied in many different forms and should not be construed as limited to the embodiment set forth herein; rather, this embodiment is provided so that this disclosure will be thorough and complete, and will fully convey the scope of the invention to those skilled in the art.

The composition of the present invention rapidly removes organic contaminants from a surface. Moreover, the composition is biodegradable, and has a flash point substantially higher than the RCRA limit (40 CFR 261.21) of greater than 140° F. The organic contaminants which may be removed include for example, oils, greases, waxes, paraffins, tars, asphaltenes, and the like. The contaminant may be removed from any surface upon which such contaminant typically accumulates including metal surfaces such as those employed in rail car and petrochemical processing applications. Specifically, the composition comprises a terpene-based component, an alkyl pyrrolidone and a surfactant. Water can be added to dilute the composition.

Suitable terpene-based components have the general chemical formula of $C_{10}H_{16}$ and are based on the isoprene unit $C_5H_8$. Preferred terpene compositions of the present invention include d-limonene, alpha-terpineol, beta-terpineol, alpha-pinene, beta-pinene, alcohols of such compositions, or mixtures thereof. Additionally, terpenes with a flash point greater than 140° F. may be employed. A particularly preferred terpene is SCM/Glidco Organics of Jacksonville, Fla., Glidsol-180, Reentry Solvent D® sold by Environmental Solvents of Jacksonville, Fla., Petroferm® D-312 sold by Petroferm Inc. of Fernandina Beach, Fla., and Petroferm® Bioact sold by Petroferm Inc. of Fernandina Beach, Fla.

Preferably, the terpene-based component is employed in an amount ranging from 20 to 50 percent by weight of the composition, more preferably, from 30 to 40 percent by weight, and most preferably, from 31 to 35 percent by weight.

Suitable alkyl pyrrolidones include $C_1$–$C_6$ pyrrolidones such as 2-ethyl pyrrolidone, N-methyl pyrrolidone, 2-methyl pyrrolidone, propyl pyrrolidone butyl pyrrolidone, and mixtures thereof. A particularly preferred pyrrolidone is M-pyrol™ sold by ISP Technologies and is a 1-methyl-2-pyrrolidone.

Preferably, the alkyl pyrrolidones is employed in an amount ranging from about 20 to about 40 percent by weight of the composition, more preferably, from 30 to 40 percent by weight and most preferably, from 31 to 35 percent by weight.

Any suitable surfactant or mixtures of surfactant can be used and can be of the non-ionic, anionic, cationic or amphoteric type, and of natural or synthetic origin. Suitable surfactants for use in the present invention include, but are not limited to, nonylphenol alkanolamide, (nonylphenoxy) polyethylene oxide, sodium salts of petroleum sulfonic acid, sorbitan sesquioleate, nonylphenol ethoxylate (3–12 moles of ethylene oxide), alcohol ethoxysulfate, polyoxyethylene-polyoxypropylene block copolymer, octylphenoxypolyethoxyethyanol (3–12 moles ethylene oxide), octylphenol ethoxylate (3–12 moles ethylene oxide), and mixtures thereof. Preferred surfactant include non-ionic surfactants such as Mazclean EP™ sold by PPG Industries of Gurnee, Ill., along with T-Det N9.5™ sold by Harcros Chemicals of Kansas City, Kans.; Steol L-101™ sold by Stepan Co. of Northfield, Ill.; Pluronic L-101™ sold by BASF of Wyandotte, Mich.; and Triton X-100™ and Triton X-114™, both of which are sold by Union Carbide of Danbury, Conn.

Preferably, the surfactant is employed in an amount ranging from 5 to 40 percent by weight of the composition, more preferably, from 20 to 40 percent by weight, and most preferably, from 31 to 35 percent by weight.

An inorganic scale removing compound may be employed for removing inorganic scale from a surface. For the purposes of the invention, the term "inorganic scale" may be construed to include, but is not limited to, oxides, sulfates, and phosphates of metals such as iron, calcium, and barium. Any appropriate inorganic scale removing compound may be used including, but not limited to, polycarboxylic acids, aminopolycarboxylic acids, along with salts and mixtures thereof. Aqueous blends of any of the above components may be employed. Suitable polycarboxylic acids include citric acid, oxalic acid, and mixtures thereof. Suitable aminopolycarboxylic acids include ethylenediaminetetraacetic acid (EDTA), diethylenetriaminepentaacetic acid, triethylenetetraaminehexaacetic acid, N-2-hydroxyethylethylenediaminetriacetic acid, propylene-1,2-diaminetetraacetic acid, propylene-1,2-diaminetetraacetic acid, nitrilotriacetic acid, the ammonium, alkylammonium and alkali metal salts of the acids, and mixtures thereof.

A hydrazide may be employed as an inorganic scale removing compound, alone or in mixture with any of the above compounds. For the purposes of the invention, a hydrazide may include any suitable hydrazide compound, an alkali metal or ammonium salt of the hydrazide compound, or mixtures thereof. Hydrazides which may be employed are numerous and include those described, for example, in U.S. Pat. Nos. 4,609,757 and 4,726,907 to D'Muhala et al.; and U.S. Pat. No. 4,708,805 to D'Muhala, the disclosures of which are incorporated by reference in their entirety. Typically, the hydrazides are derived from known reactions which typically involve amino polycarboxylic acids such as, for example, an amino polyacetic acid. Specifically, tetrahydrazide formed from EDTA may be employed. Other hydrazides which may be used include carboxyhydrazides, i.e. polycarbazic acids. Exemplary polycarbazic acids are of the general formula:

$$(R)_2—N—[CH_2CH_2N(R)]_m—R$$

wherein R is the group $CH_2$—CO—NH—NH—COOH and m is 0 or an integer from 1 to 4. Preferably, m is 0 or 1. Another suitable polycarbazic acid includes that described by the general formula:

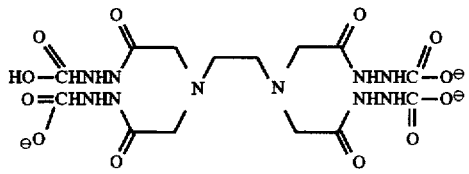

The inorganic scale removing compound may be employed in any appropriate amount. Preferably, the composition includes from 0.1 to 50 weight percent of the inorganic scale removing compound, and more preferably from 3 to 10 weight percent.

Various dispersants may be used in the invention. A suitable dispersant for organic contaminants is Tamol SN™, a sodium salt of naphthalenesulfonic acid, available from Rohm & Haas, Philadelphia, Pa. A suitable dispersant for inorganic scale is sodium lignosulfonate. Preferably, the composition may comprise between 0 to 1 weight percent of dispersant.

Various foamers may be used in conjunction with the inorganic scale removing compound. The foamers are designed to increase the contact time on the surface, especially a vertical surface. Preferably, polyethylene glycol is employed as the foamer. A commercially preferred foamer composition includes 33 weight percent of Polyglycol P 425™ sold by Dow Chemical Company of Midland, Mich. and 67 weight percent of Tegobetaine S™ sold by Goldschmidt Chemical Corp. Preferably, the composition comprises between about 0 to about 1 weight percent of foamer.

A gelling agent may be employed with the inorganic scale removing compound. The gelling agent is designed to increase the contact time with the surface, especially a vertical surface. Preferably, hydroxypropyl methylcellulose is utilized. A commercially preferred gelling agent is Methocel 311™ sold by Dow Chemical Corp. of Midland, Mich. The composition preferably comprises between 0 to 1 weight percent of gelling agent.

The present invention is also directed to a method for decontaminating a surface. The method includes providing a surface having an organic contaminant, and contacting the surface with the composition so as to decontaminate the surface. The surface may be coated or uncoated. Suitable examples of coatings which may be on the surface include phenolics and rubber-lining.

Any conventional technique can be employed to contact the composition to the metal object. Contacting of the object may be accomplished by spraying, immersing, showering, etc. After contacting, the object is preferably subjected to a water rinse. This invention accomplishes the rapid, safe removal of organic residues from surfaces and containers. The invention is biodegradable (OECD Method 301D), water dilutable while maintaining effectiveness, and has a flash point above the RCRA limit (>140° F.).

In a preferred embodiment, the method further comprises separating the composition from the contaminant such that the composition may be re-used. This may be done by any known means, such as by heating the composition and contaminant. Specifically, the composition and contaminant are typically present in the form of an emulsion. Upon application of a water rinse, de-emulsification of the entrapped contaminant occurs allowing for minimal waste volumes and re-use of the composition of the invention with no cross-contamination.

The method of the invention also may include applying an inorganic scale removing compound to the surface so as to remove inorganic scale that may be present on the surface.

The inorganic scale removing compound may be applied by any suitable means known to the skilled artisan. For example, such compounds could be applied to the surface in a dip tank with or without agitation; sprayed onto the surface at low to high pressures such as 30 to 250 psi; foamed onto a surface using a foaming additive; and gelled onto the surface using an appropriate gelling agent.

The following examples are provided to illustrate the present invention, and should not be construed as limiting thereof.

EXAMPLE 1

A charge of 220 gallons of a composition according to the invention (33% terpene-based composition, 33% 1-methyl-2-pyrrolidone, and 34% non-ionic Mazclean EP surfactant) was diluted with water to a total volume of 2000 gallons. A Butterworth system was used to spray the warm (140° F.) emulsion into the contaminated rail cars for approximately 2–4 hours, depending on the level of contamination and identity of the contaminant. The system circulated the chemistry. At two points the system chemistry was "recharged" with fresh chemical, a total of 55 more gallons of invention was added. Also, periodically, the contaminants were vacuumed off the top of the holding tank of emulsion, which was possible due to the feature of the invention that de-emulsifies the contaminant while maintaining the invention emulsion as re-usable. Waste disposal was then just the contaminant. A total of 91 rail cars were cleaned to the satisfaction of the inspectors, with no cross-contamination observed. The contaminants included ammonium nitrate urea and ammonium thiosulfate solutions, all of which would have given off large volumes of irritating ammonia vapors if caustic was used. With the invention, no ammonia odor was noticed at all. Table 1 shows the complete list of contaminants removed.

TABLE 1

| Cleaned | Rail Cars |
|---|---|
| Ammonium nitrate urea solution | 17 |
| Ammonium thiosulfate solution | 1 |
| Asphalt after diesel wash | 7 |
| Bright stock oil | 1 |
| Corn oil | 1 |
| Detergent acrylate | 1 |
| Diesel | 1 |
| Fuel oil after diesel wash | 1 |
| #6 fuel oil after diesel wash | 2 |
| Grease | 1 |
| Inedible tallow | 3 |
| Lard | 1 |
| Lorals | 1 |
| Lube oil | 20 |
| Magnesium chloride | 4 |
| Molasses | 1 |
| Nitrogen fertilizer solution | 1 |
| petroleum wax | 1 |
| Phenol | 1 |
| Polyols | 1 |
| Residual oil after diesel wash | 8 |
| Sodium silicate | 2 |
| Soybean oil | 5 |
| Tall oil after diesel wash | 4 |
| Tallow | 1 |
| Waste water | 2 |
| Wax | 1 |
| White oil | 1 |

EXAMPLE 2

Scheduled maintenance of a distillation column of an oil refinery requires the removal of the foulants from within the vessel to allow the trays and other internal components to be inspected and serviced. In the past, this has been achieved by manually scooping out such materials, often with the assistance of several days of water washing and steaming to loosen the deposits within the column. Rather than this time and labor intensive cleaning, the solution of Example 1 (33% terpene hydrocarbon solvent, 33% 1-methyl-2-pyrrolidone, and 34% non-ionic Mazclean EP surfactant) was chosen.

The refinery personnel pumped 550 gallons of the invention into a temporary holding vessel (reflux drum) with a pump capable of pumping out of the drum into the top of the tower. This would allow the invention solution (diluted with water) to cascade down to the lower elevations with the column and be circulated back to the reflux drum. The dilution of the invention wasto a total 4,000 gallons of water (14% solution). The solution was pumped to the top of the tower over 40 minutes, with no returns evident, so additional water was added to make the total 10,000 gallons (5.5% solution). The application temperature was 140° F. Operations continued intermittently for over two days; the refinery personnel would attempt to make as many circulations as possible during their day shift, and would continue to heat via steam overnight as the last volume of the invention solution was pumped through the relux line and allowed to cascade down through the trays overnight.

At the conclusion of the process, the solution was drained from the bottom of the columns and hauled from the unit via vacuum trucks. The unit supervisor commented that this was the first occasion where upon opening the manways, they could see the tops of the trays. Additionally, when the refinery personnel monitored for benzene levels during the vacuuming operations, the levels were all below the 50 ppm range. On three consecutive days, levels read 9, 8, and 3 ppm; monitoring was then no longer required and personnel were able to work without respirators as the residuals were vacuumed from the column's internals.

EXAMPLE 3

The removal of asphalt from carbon steel coupons using various compositions of the invention was investigated. A 50 mil layer of asphalt was coated on carbon steel coupons. A 500 ml solution (10% by volume) of Example 1 was prepared and heated to 65° C. For comparison, 500 ml solutions of 10% Serv-Tech™ A and 10% Serv-Tech™ B, both of which are sold by Serv-Tech, Inc. of Houston, Tex.; and 10% U-657 Zymeflow™ sold by United Laboratories of St. Charles, Ill. were prepared and heated to 65° C. The Serv-Tech® A and B solutions are described in U.S. Pat. No. 5,356,482 to Mehta et al. and are listed below:

| | Weight Percent |
|---|---|
| Serv-Tech A: | |
| D-Limonene | 57% |
| Plutonic 10R-5 | 90% |
| Monamulse 653-C | 17% |
| Butyl Cellusolve | 3% |
| Macon 10 | 5% |
| Water | 9% |
| Serv-Tech B: | |
| D-Limonene | 57% |
| Pluronic 10R-5 | 9% |
| Monamulse 653-C | 17% |
| Igepal CO 530 | 8% |
| Water | 9% |

The coupons were placed in the solutions and agitated using a 1" stir bar at 500 rpm. The condition of the coupon and the solution was noted after every 30 minutes. The following results were obtained:

| 10% Solution | Time: 1 hour % Asphalt Removed | Comments |
|---|---|---|
| Example 1 | 60 | solution is brown |
| Serv-Tech ™ A | 50 | solution is tan |
| Serv-Tech ™ B | 50 | solution is dark brown |
| U-657 | <1 | no solution discoloration |

As is evident, the present invention exhibited a faster rate of contaminant removal relative to the Serv-Tech™ and U-657 solutions.

That which is claimed:

1. A method of decontaminating a surface comprising:

providing a surface having an organic contaminant contained thereon;

contacting the surface with a composition which consists essentially of 20 to 50 percent by weight of a non-alcohol terpene component, wherein said non-alcohol terpene component is selected from the group consisting of d-limonene, alpha-pinene, beta-pinene, 1-methyl-4-isopropylene-1-cyclohexane, and mixtures thereof; 20 to 40 percent by weight of an alkyl pyrrolidone, and 5 to 40 percent by weight of a surfactant so as to decontaminate the surface.

2. The method according to claim 1 wherein the alkyl pyrrolidone is selected from the group consisting of 2-ethyl pyrrolidone, 2-methyl pyrrolidone, N-methyl pyrrolidone, propyl pyrrolidone, butyl pyrrolidone, and mixtures thereof.

3. The method according to claim 1 wherein the surfactant is selected from the group consisting of nonylphenol alkanolamide, (nonylphenoxy)polyethylene oxide, sodium salts of petroleum sulfonic acid, sorbitan sesquioleate, nonylphenol ethoxylate, alcohol ethoxysulfate, polyoxyethylene-polyoxypropylene block copolymer, octylphenoxypolyethoxyethanol, octylphenol ethoxylate, and mixtures thereof.

4. The method according to claim 1 further comprising water.

5. The method according to claim 1 wherein the surface contains inorganic scale and further comprising applying an inorganic scale removing compound to the surface so as to remove the inorganic scale from the surface.

6. The method according to claim 5 wherein the inorganic scale removing compound is selected from the group consisting of ethylenediaminetetraacetic acid, citric acid, oxalic acid, a hydrazide, and mixtures thereof.

7. The method according to claim 1 further comprising separating the composition from the contaminant such that the composition may be re-used.

8. The method according to claim 7 wherein said step of separating the contaminant and composition is carried out by heating the composition.

* * * * *